US005140936A

United States Patent [19]

Strong et al.

[11] Patent Number: 5,140,936

[45] Date of Patent: Aug. 25, 1992

[54] DEVELOPMENT APPARATUS HAVING MEANS FOR PARTIALLY SKIVING MAGNETIC DEVELOPER

[75] Inventors: Douglas B. Strong, Rochester; Edward M. Cyrana, Webster; Thomas K. Hilbert, Spencerport, all of N.Y.

[73] Assignee: Eastman Kodak Company, Rochester, N.Y.

[21] Appl. No.: 631,124

[22] Filed: Dec. 20, 1990

[51] Int. Cl.[5] ..... G03G 15/09

[52] U.S. Cl. ..... 118/657; 355/251

[58] Field of Search ..... 118/657, 658, 656, 653; 355/245, 251, 253, 260

[56] References Cited

U.S. PATENT DOCUMENTS 3,543,720 12/1970 Drexler et al. ..... 355/253
4,101,211 7/1978 Kayson ..... 118/653
4,800,412 1/1989 Ueda ..... 355/251
4,851,872 7/1989 Murasaki et al. ..... 355/253
5,047,807 9/1991 Kalyandurg ..... 355/269

*Primary Examiner*—A. T. Grimley
*Assistant Examiner*—Brasé Sandra L.
*Attorney, Agent, or Firm*—Tallam I. Nguti

[57] ABSTRACT

A development apparatus for developing images with magnetic toner particles contained in magnetic developer material. The development apparatus has a magnetic development roller and a device for removing a partial amount of magnetic chains of the developer material from the magnetic development roller. The device includes a first magnet generating a first magnetic field for standing the magnetic chains on a first end, and a second magnetic generating an opposite magnetic field for standing such chains on a second and opposite end. The device also includes a skiving plate that is positioned between the first and second magnetic fields.

12 Claims, 6 Drawing Sheets

DEVELOPMENT APPARATUS HAVING MEANS FOR PARTIALLY SKIVING MAGNETIC DEVELOPER

BACKGROUND OF THE INVENTION

1. Field of the Invention

The present invention relates to electrostatographic machines such as copiers or printers, and more particularly to a development apparatus for use in such machines to develop latent images on an image-bearing member with toner particles.

2. Brief Description of the Prior Art

Electrostatographic process machines such as copiers and printers, which, for example, produce or reproduce toned images on selected substrates by employing electrostatic charges and toner particles on an dielectric image-bearing surface such as a photoconductive surface are well known. Typically, such machines operate through a sequence of currently well known steps. In a copier or printer type of such machines, for example, these steps include (1) charging of an insulated photoconductive surface with electrostatic charges, (2) forming a latent image electrostatically on such surface by selectively discharging areas on such surface, (3) developing the electrostatic image so formed with particles of toner, (4) transferring the toned image to a suitable substrate for fusing thereon to form a permanent record, and (5) cleaning by removing residual toner and/or other particles from the photoconductive surface in preparation for similarly reusing the surface to produce another such image.

The images so produced can be in the form of line copy, half-tones, or solid colors, for example, solid blacks when black color toner particles are used in the development step. Line copy images so produced include magnetic characters for processing on magnetic ink character recognition or (MICR) equipment. The effectiveness and reliability of such MICR equipment, as well as a significant degree of the overall quality of the toned characters produced by the electrostatographic machine, depend importantly on the efficiency and quality of the development step. Several types of development apparatus therefore have been developed and continue to be developed for performing such efficient and quality image development as required.

Some examples of such development apparatus are disclosed in U.S. Pat. No. 3,543,720, issued Dec. 1, 1976 in the name of Roger A. Drexler and illustrated in FIGS. 2, 3, and 4 of the drawings to this application. As disclosed in FIGS. 2–4, such a development apparatus shown generally as 130, includes an elongate housing 42 and two development rollers 44, 46. The housing 42 has a first sump portion 48 within which is located a feed auger 50 for mixing and feeding developer material 131 from the front end 52 of the apparatus 130 to the rear end 54 thereof. Developer material 131 or fresh toner particles added into a front portion 56 of the apparatus 130 (FIG. 1) is moved by the feed auger 50 from the front end 52 to the rear end 54.

Ordinarily, the developer material 131 consists of non-magnetic toner particles and of magnetizable iron carrier particles. As shown in the drawings of FIGS. 2–4, the development rollers 44 and 46 are each provided with sets of magnets for example, the sets SIN1, and S2N2–N5S3 of roller 46, which have polarities as shown. The magnets are mounted therewithin for magnetically attracting the developer material 131 onto the surface of each roller 44, 46. As shown, each roller 44, 46 includes a non-magnetic rotatable outer shell 60, 62 respectively and a stationary core 64, 66 respectively onto which the sets of magnets are assembled. Magnetic fields generated by each set of magnets attract the developer material 131 and hold it on the surface of the shell 60, 62 respectively, while such shell 60, 62 is being rotated in the direction of the arrows 68, 70 for example. As is well known, as the shells 60, 62 are being rotated, as such, through areas with, and areas without magnetic fields (FIGS. 3 and 4) about each roller 44, 46, the magnetized developer material 131 on each roller will form bristle-like patterns which stand up within the magnetic field areas. These bristle-like patterns, however, will collapse into a loose non-magnetic pile in non-magnetic field areas, for example in the area shown as 72 (FIG. 3).

As shown in FIG. 2, as the feed auger 50 moves the developer material 31 from the front end 52 to the rear end 54, the development rollers 44, 46 also move such developer material around from side-to-side and up-and-down within the housing 42. In an electrostatographic copier or printer, the rollers 44, 46 can thus move the developer material 31 into development contact with electrostatically formed images 74 being carried on an adjacently mounted image-bearing member 76 moving, for example, in the direction of the arrow 78. Development of the images 74 through such contact of course uses up or depletes toner particles contained in the developer material 131.

Accordingly, as shown in FIGS. 2 and 3, the apparatus 130 includes means shown generally as 80 for moving spent or toner depleted developer material from the rear end 54 back to the front end 52, and for for balancing the end-to-end flow of the developer material 131 therewithin. The means 80 includes a second sump portion 82 within which is located a return auger 84 for moving the spent developer material from the rear end 54 back to the front end 52. Means such as a paddle wheel 85 located within the front portion 56 then move the spent developer material from the second sump portion 82 back over to the first sump portion 48. Fresh replenishment toner particles can then be added appropriately into the spent developer material as it is being moved as such through the front portion 56.

The means 80 also includes an opening 86, which is formed through a sump dividing wall, into the sump 82, and a mechanical skive plate 88 which is mounted within the opening 86 and projects into a small gap forming relationship with the periphery of shell 62 of development roller 46. As shown in FIGS. 2–4, the plate 88 is mounted such that its skiving edge 90 forms such a small gap against the roller 46 in the non-magnetic field area 72 of roller 46. As shown in FIG. 2, the desirability and need to form such a gap in a non-magnetic field area are so important that one of the magnets adjacent thereto, shown as a south pole magnet S3 is shortened so as to leave a non-magnetic field area within the gap. Note that ordinary type developer material 131, which contains magnetizable carrier particles and non-magnetic toner particles, collapses into a loose non-magnetic pile on the surface of the roller 46 when being moved through such a non-magnetic field area 72. As such, there are no undesirable forces to interfere with the plate 88 easily and effectively skiving off or removing a predetermined partial amount of such a loose non-magnetic pile of the developer material 131 from the development roller 46. The partial amount so removed drops gravitationally into the sump 82 and can then be returned by the auger 84, from the rear end 54 to the front end 52.

Unfortunately, however, the apparatus 130 of FIGS. 2–4, and particularly its partial skiving features shown as 80 have been found not to work well, for example, with magnetic developer material containing magnetic particles. An example of such magnetic developer material is disclosed in commonly assigned U.S. patent application Ser. No. 433,248, filed Nov. 8, 1989 in the names of John M. Spence, Robert E. Contois, and Lawrence P. DeMejo, and entitled "TWO-COMPONENT MAGNETIC DEVELOPER FOR MAGNETIC CHARACTER RECOGNITION." The contents of this particular U.S. application are hereby incorporated by reference.

As disclosed in this incorporated U.S. application, the magnetic developer material therein consists of needle- or acicular-shaped magnetic stainless steel carrier particles, and of magnetic toner particles. The magnetic toner particles include particles of a binder resin medium, and particles of magnetic material dispersed therein. The magnetic developer material, as such, possesses magnetic fields of its own which result in the formation of magnetic chains of the particles thereof.

In the prior art apparatus 130 of FIGS. 2–4 for example, when magnetic developer material such as that disclosed in the incorporated application is moved around therein by the development rollers 44, 46, such magnetic chains will stand up in the form of bristles when moving through the magnetic field areas of each roller. Unlike the case of ordinary developer material 131 however, these magnetic chains of the magnetic developer material continue to persist even in the non-magnetic field areas of such rollers, for example the area 72 of the roller 46. Unfortunately, in the non-magnetic field area such as 72 where the partial skiving means 80 are located, these persistent magnetic chains span the small gap between the roller 46 and the edge 90 of the plate 88, thereby bridging and closing off the gap. As a result, attempts to partially remove some of the magnetic developer material D fail and all of such magnetic developer material which contacts the skiving edge 90 is skived off or removed by the plate 88 from the roller 46, and is directed into the sump portion 82 for return to the front end 52. Attempts to remedy this by widening the gap thereat, results instead in the persistent magnetic chains causing all such magnetic developer material thereat to slide through the widened gap and under the edge 90 of the plate 88 despite making what would otherwise be a partial skiving contact with the skiving edge 90.

Such all-or-nothing flow of the magnetic developer material over or under the plate 88, of course, results in an unbalanced flow of such developer material in the apparatus 130, and more importantly, in poor image development by the electrostatographic apparatus or machine 10.

SUMMARY OF THE INVENTION

It is an object of the present invention to provide a development apparatus that can efficiently handle and partially recirculate magnetic developer material therein.

It is also an object of the present invention to provide in a development apparatus which includes a magnetic development roller for handling magnetic developer material, a device for removing a desired partial amount of such developer material from the development roller.

In accordance with the present invention, a development apparatus is provided that has a rotatable development roller and is usable in an electrostatographic machine for developing latent images using magnetic developer material. The development apparatus includes a device for removing a desired partial amount of such magnetic developer material from the outside surface of the development roller.

The removing device includes a first magnet that has a first polarity. The first magnet is mounted within the development roller and generates a first magnetic field thereabout for standing magnetic bristles of particles of the magnetic developer material on a first end thereof on the outside surface of the development roller. The removing device also includes a second magnet that has a second and opposite polarity. The second magnet is mounted within the development roller and generates a second magnetic field thereabout for standing such magnetic bristles of the developer material on a second and opposite end thereof on the outside surface of the development roller. Relative to the rotation of the development roller, the second magnetic field is generated so as to be immediately downstream of the first magnetic field, thereby tending to cause a flipping of the magnetic bristles of the developer material from standing on the first end to standing on the second end thereof on the outside surface of the development roller.

The device further includes a skiving plate member that has a skiving edge which is positioned between such first and second magnetic fields, and which is spaced thereat a small gap from the outside surface of the development roller. The plate member is positioned, as such, so that the skiving edge thereof partially interferes with, and thereby severs such flipping magnetic bristles into first and second amounts. The first amount remains on the development roller therefore by passing under the skiving edge, and the second amount passes over the skiving edge and is directed by the skiving plate member away from the development roller.

BRIEF DESCRIPTION OF THE DRAWINGS

In the detailed description of the invention presented below, reference is made to the drawings wherein like numerals refer to like features, and in which.

DETAILED DESCRIPTION OF THE PREFERRED EMBODIMENT

Because electrostatographic reproduction apparatus or machines are well known, the present description will be directed in particular to elements forming part of or cooperating more directly with the present invention. Apparatus not specifically shown or described herein are selectable from those known in the prior art.

Figure 1:
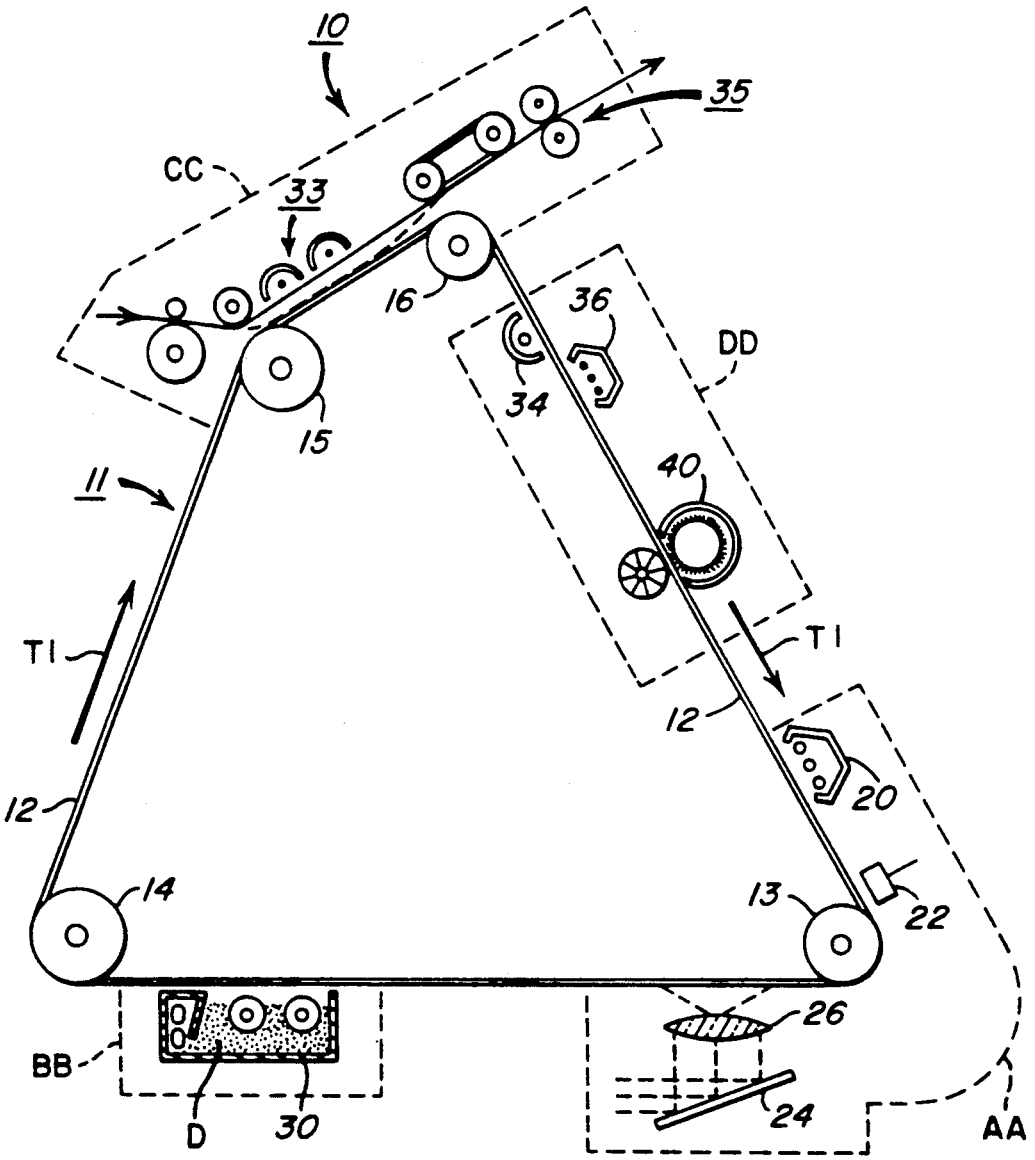
FIG. 1 is a schematic illustration of an electrostatographic machine, such as an optical copier, including the development apparatus of the present invention.

Referring now to FIG. 1, an electrostatographic reproduction apparatus or machine such as an optical copier is shown generally as 10. The apparatus 10, as shown, includes an image-bearing member 11 which is an endless flexible belt which has a frontside image-bearing surface 12. Although the member 11 is shown as an endless flexible web trained about the series of rollers 13–16, it should be understood that an image bearing member in the form of a rigid drum can be used instead. The member 11 as shown is trained about a series of rollers 13–16 for movement in the direction, for example, of the arrow T1. One of such rollers, for example, the roller 13, can be a drive roller for repeatedly moving the member 11 sequentially through a series of process stages shown, for example, as AA, BB, CC and DD.

As shown in FIG. 1, clean and charge-free portions of the image-bearing member 11 initially move through the stage AA where electrostatic charges and/or light, are used in one manner or another (as is well known in the art) to electrostatically form on the surface 12 latent images of an original document. Typically, the stage AA includes components such as a primary charger 20 or other charge depositing component (not shown). The image of an original can thus be formed electrostatically on the surface !2, for example, by charging the surface 12 using the primary charger 20, and then imagewise discharging portions of such surface using an electronic printhead 22 or the like, and/or an optical system as shown partially. A typical optical system includes a light source (not shown) that illuminates a document sheet. The light rays reflected from the document sheet can then be reflected by a mirror such as 24 through a lens 26, and onto the surface 12 for such optical imaging.

The imaged portion of the image-bearing member 11 next moves to the stage BB where the latent image thereon is developed, that is, is made visible, with charged particles of toner. Stage BB therefore includes a development apparatus, such as the development apparatus of the present invention, shown generally as 30. The development apparatus 30 of the present invention contains a two-component magnetic developer material D that is comprised of magnetizable stainless steel carrier particles, and of magnetic toner particles which include magnetic particles. Such magnetic developer material is disclosed for example in the afore-mentioned U.S. application Ser. No. 433,248 (incorporated here by reference), and is particularly suitable for developing magnetic characters for use on a magnetic ink character recognition (MICR) machine. The development apparatus 30 of the present invention, as such, will be described more fully below.

During development of the latent image at the development apparatus 30, the toner particles in the developer material D transfer to the image-bearing surface 12, and there adhere to the electrostatically formed image thereon, thereby making the image visible. After such development, that portion of the image-bearing member 11 carrying the toner image thereon, then moves to the stage CC.

The stage CC, as shown, includes an image transfer station 33 where the visible toner image on the surface 12 is transferred to a suitable receiver sheet, such as a sheet of paper, which is fed in registration to the station 33 along a sheet travel path. After such image transfer, the copy sheet then travels to a fusing station 35, as shown, where the toner image is permanently fused to the receiver sheet to form a hard copy. Meanwhile, the used portion of member Il, from which the toner image was transferred, moves on towards the initial stage AA to again begin another imaging cycle.

To ensure continued production of high quality hard copies during subsequent cycles of the above imaging process, it is necessary to effectively clean each such used portion of the surface 12 before it is again reused. Such cleaning therefore must effectively remove any residual charges and residual particles remaining on the surface 12 following image transfer. Accordingly, such cleaning is carried out at stage DD where devices are located for removing such residual charges and particles. As shown for example, the residual charges can be removed by a discharge lamp 34 and/or neutralized by a corona 36, and the residual particles can be removed by a cleaning means or apparatus shown as 40. The cleaning apparatus 40 may, for example, be any conventional apparatus such as a brush, a roller, a blade or a magnetic brush cleaning apparatus which are well known in the art.

Figure 2:
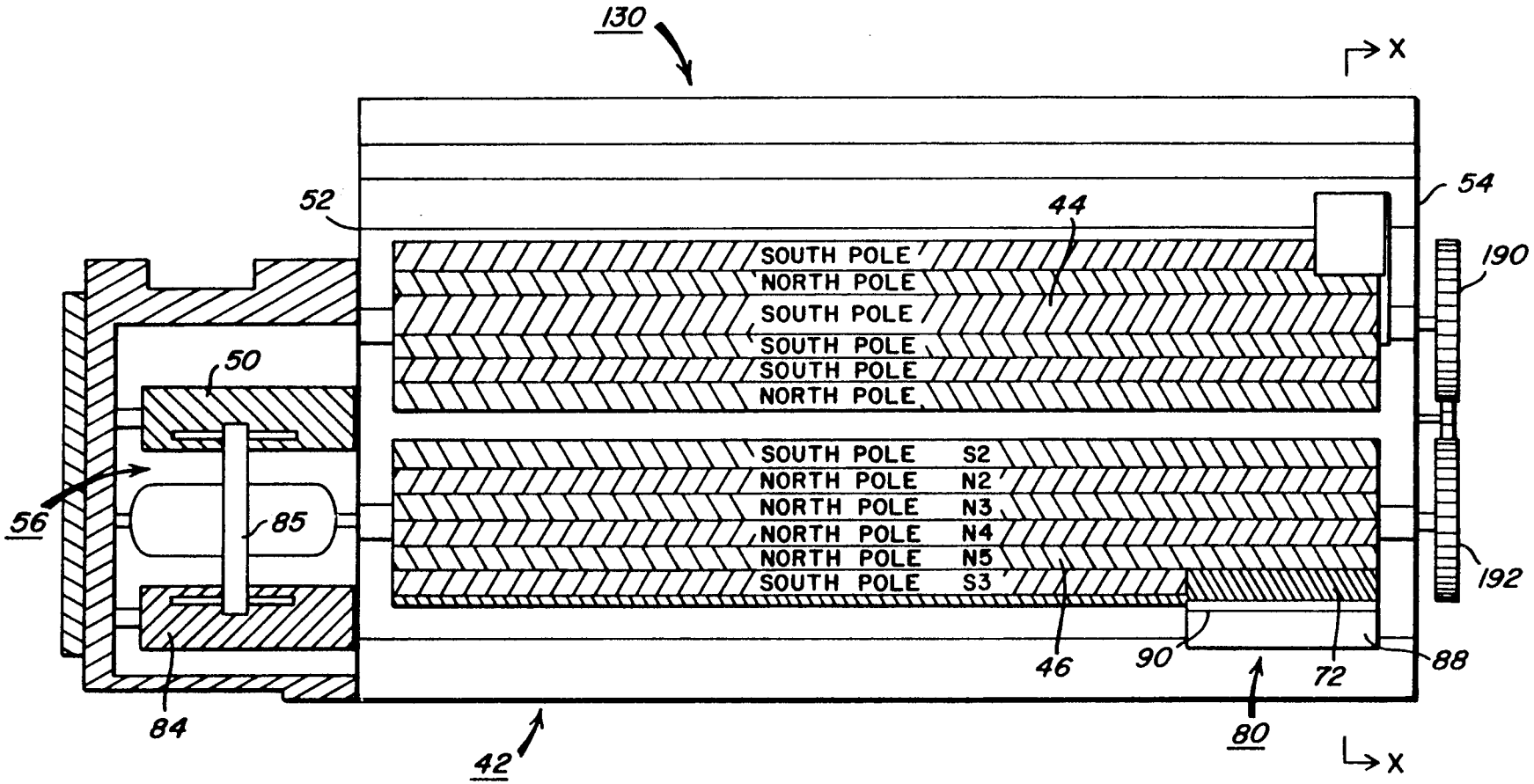
FIG. 2 (PRIOR ART)
FIG. 2 is a top view of a prior art development apparatus.
Figure 3:
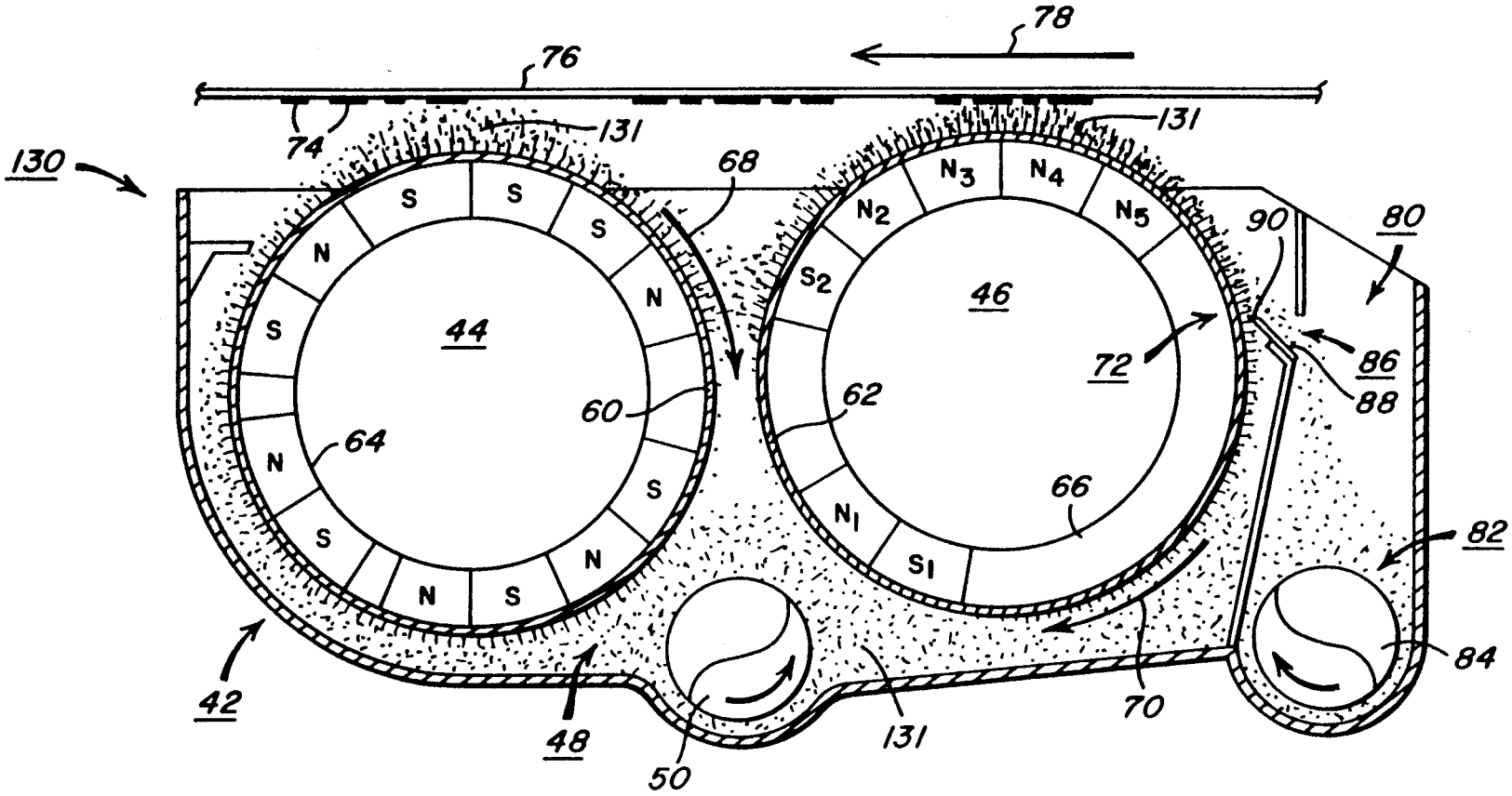
FIG. 3 (PRIOR ART)
FIG. 3 is a schematic cross-sectional view of the apparatus of FIG. 2 taken along line X—X.
Figure 4:
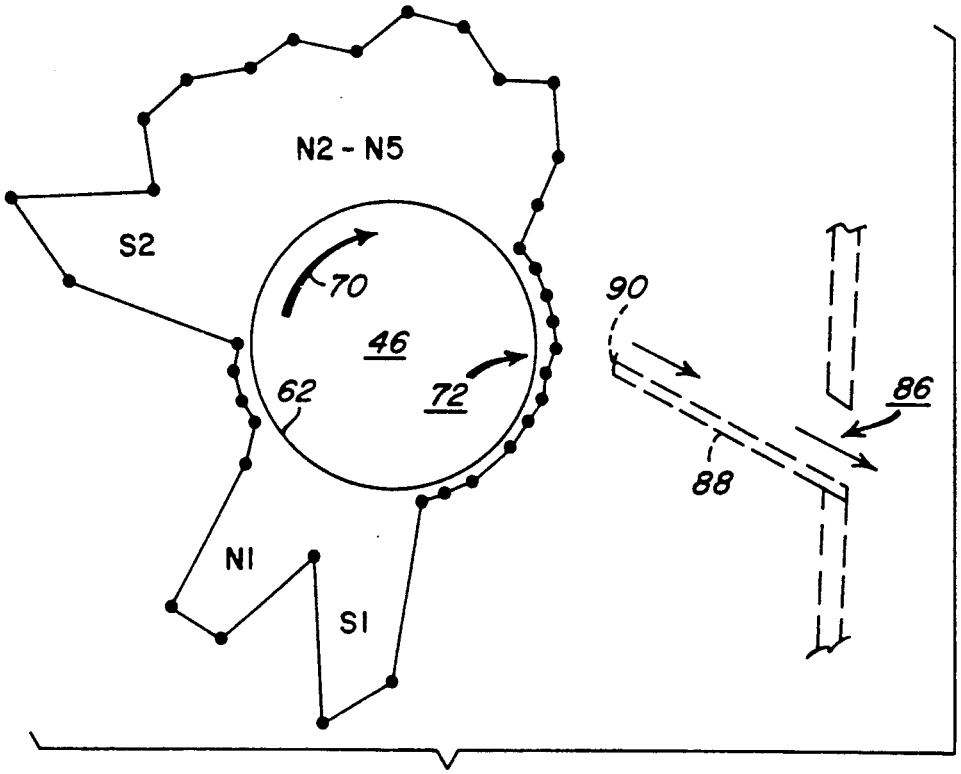
FIG. 4 (PRIOR ART)
FIG. 4 is a graphical illustration of the magnetic fields in the magnetic and non-magnetic field areas around the second or right side development roller of FIGS. 2 and 3.
Figure 7:
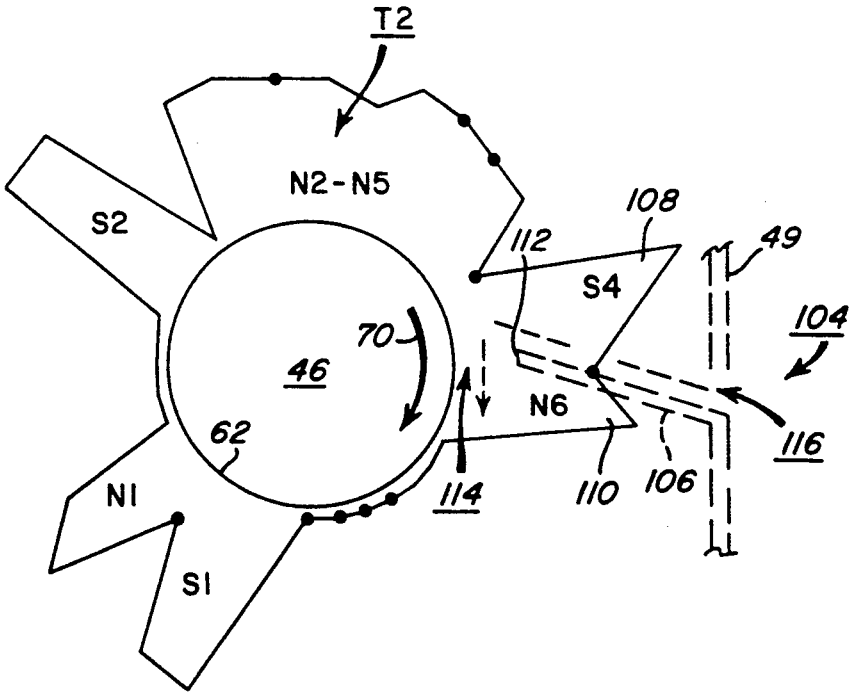
FIG. 7 is a graphical illustration of the magnetic fields in the magnetic and non-magnetic field areas around the second or right side development roller of FIGS. 5 and 6, and including the device of the present invention.
Figure 5:
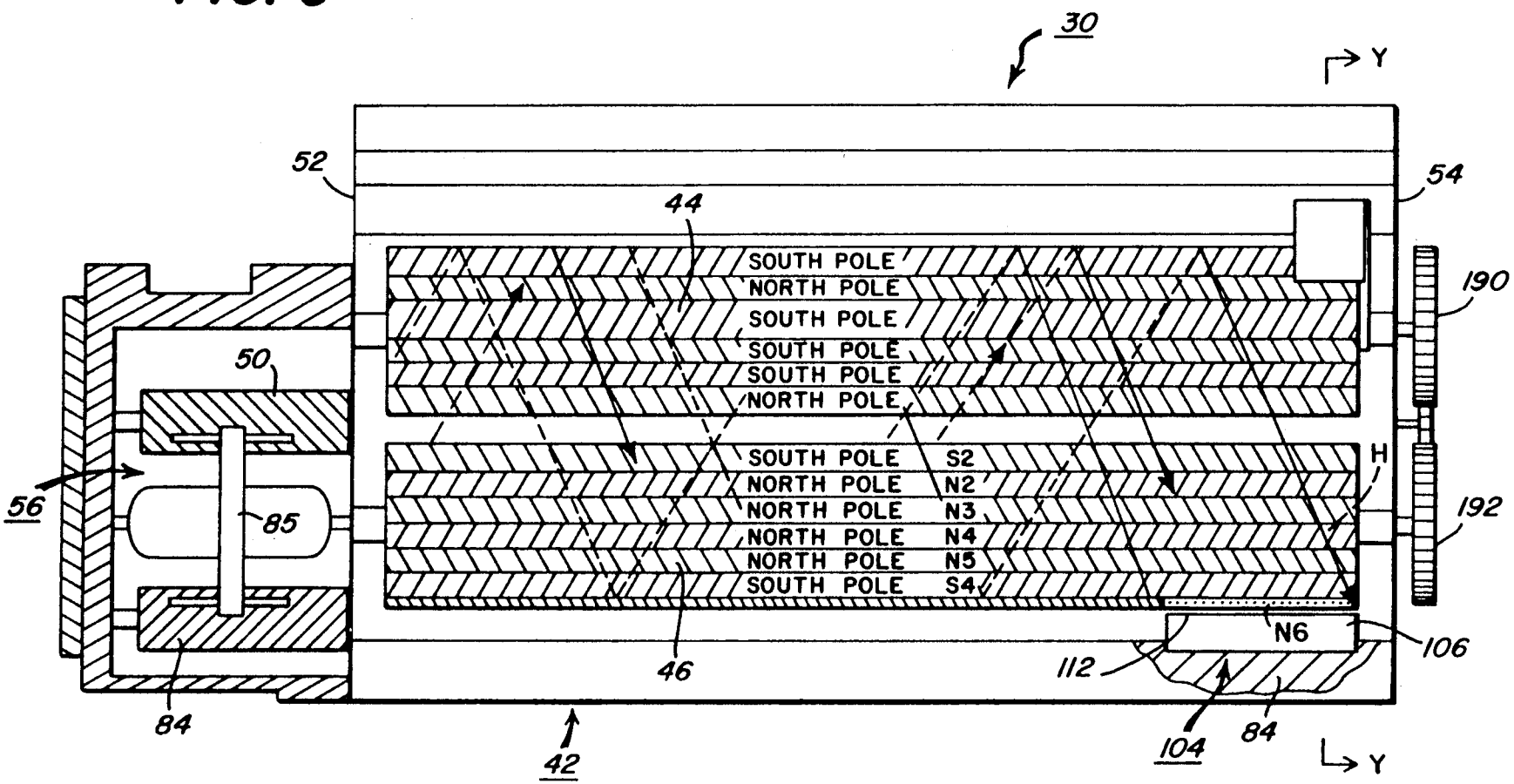
FIG. 5 is a top view of the development apparatus of the present invention.
Figure 6:
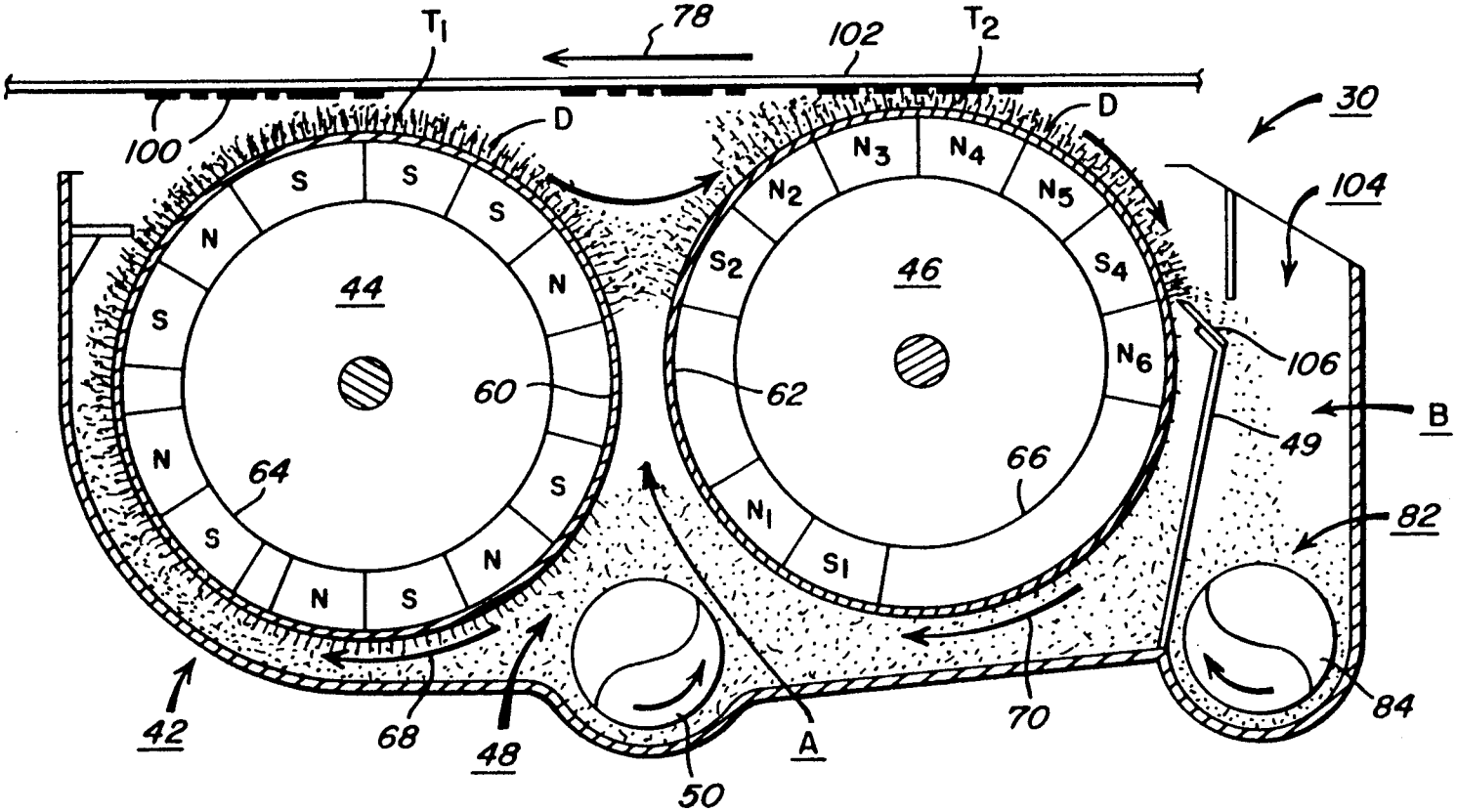
FIG. 6 is a schematic cross-sectional view of the development apparatus of FIG. 5 taken along line Y—Y.

Referring now to FIGS. 5–7, the development apparatus 30 of the present invention is illustrated in detail. The apparatus 30, as shown, includes the device of the present invention for partially skiving magnetic developer material from a development roller, as well as other features that are basically similar to those in the prior art development apparatus 130 of FIGS. 2–4. Like numerals have therefore been used where appropriate to refer to such similar features.

Accordingly, the development apparatus 30 of the present invention includes an elongate housing 42 and two development rollers 44, 46. The housing 42 has a first side compartment A and a second side compartment B. Within a first sump portion 48 in the compartment A, a first helical feed auger 50 is mounted for mixing and feeding magnetic developer material D from a front end 52 of the apparatus 30 back to the rear end 54 thereof. A similar auger 84 mounted in the second compartment B moves developer material from the second end 54 back to the first end 52. Means such as a paddle wheel 85 mounted in the first end 52 transfers developer material from the second compartment B to the first compartment A.

The magnetic developer material D being handled in the apparatus 30 consists of needle- or acicular-shaped magnetizable stainless steel carrier particles, and of magnetic toner particles. The magnetic toner particles include particles of a binder resin, and particles of a magnetic material. The magnetic developer material D, as such, possesses magnetic fields of its own which result in the formation of magnetic chains of the particles thereof. In the apparatus 30, such developer material D, and/or replenishment toner particles therefor, are added into a front portion 56 (FIG. 5) for subsequent movement and mixing.

The development rollers 44, 46 are each provided with sets of magnets, for example SIN1 and S2N2-N5 of the roller 46, for magnetically attracting the magnetic developer material D onto the surface of each roller. As shown, each roller 44, 46 includes a non-magnetic rotatable outer shell 60, 62 respectively, and a stationary core 64, 66 respectively onto which the sets of magnets are assembled. The developer material D can thus be moved in the direction of the arrows 68, 70 when attracted onto the rotatable shells 60, 62 which are driven by imparting a drive to the gears 190, 192, respectively. As shown, the magnetic chains of the particles of the developer material D form standing bristle-like patterns when being moved through areas where there are magnets and magnetic fields. Such magnetic chains, however, collapse into a magnetic pile in areas where there are no magnets and hence no magnetic fields.

As shown in FIG. 5, the combined effect of the auger 50 and the rollers 44, 46, is to move the developer material D, in the form of a repeating band shown as H, side-to-side around the first compartment A, as well as from the front 52 to the back 54. During such movement, the rollers 44, 46 carry the magnetic developer material D through development zones shown as $T_1$, $T_2$ (FIG. 6) where latent images or characters 100 being carried on an image-bearing member 102 are developed with the magnetic toner particles in the material D. In order to ensure the quality development of subsequent images or characters, the magnetic toner particles used up in development must be replenished, and the flow of the developer material D from the end 52 to the end 54 within the housing 42 must be balanced.

Therefore, in accordance with the present invention, a device designated generally as 104 is provided in the development apparatus 30 for removing a desired partial amount of the magnetic developer material D from the development roller 46 . at the end 54, for recirculation back to the end 52. The device 104 must therefore be capable of breaking the magnetic chains of the magnetic developer material D which otherwise would ordinarily cause an all-or-nothing flow of the developer material D under or over a skiving edge such as 90 positioned adjacent the development roller 46 as in the prior art apparatus 130 of FIGS. 2–4. As shown in FIGS. 5–7, the device 104 of the present invention includes a first magnet S4, a second magnet N6 and a skiving plate member 106 located near the periphery of the rotating shell 62. The first magnet S4 has a first polarity, for example an S-polarity. It is mounted to the stationary core 66 of the development roller 46 and generates a first magnetic field 108 (FIG. 7) just downstream of the development zone $T_2$, as shown relative to the direction of movement of the shell 62. The magnetic field 108 causes the magnetic chains of magnetic particles of the magnetic developer material D to stand as bristles on a first end thereof on the outside surface of the shell 62 of the roller 46.

The second magnet N6 has a second polarity that is opposite to the first polarity of the first magnet S4, for example, an N-polarity. The second magnet N6 is also mounted to the stationary core 66 of the development roller 46 for generating a second magnetic field shown as 110 thereabout. Being opposite to the first magnetic field 108, the second magnetic field 110 will cause the magnetic bristles of particles of the development material D to tend to stand on a second and opposite end thereof on the shell 62. As shown, the first magnetic field 108 is made stronger than the second field 110. The first and second magnets S4 and N6 are mounted as such to the core 66 such that the second magnetic field 110 is generated immediately downstream of the first field 108 relative to the moving shell 62. The positioning of the magnetic fields 108, 110 in this manner tends to cause a flipping of the magnetic bristles from standing on the first end (within the first field 108) to standing on the second end thereof (within the second field 110).

As shown, the device 104 further includes the skiving plate member 106 which has a skiving edge 112. The plate member 106 is mounted such that the edge 112 is positioned approximately between the first and second magnetic fields 108, 110, and so as to be spaced a small adjustable gap 114 from the outside surface or periphery of the rotating shell 62 of the roller 46. The gap 114 should be such that the edge 112 interferes with, and breaks or severs the magnetic bristles as such bristles are flipping from standing on a first end to standing on a second end in moving from the first field 108 to the second field 110. Apparently, the magnetic forces, which cause such flipping when combined with mechanical forces by the moving shell 62 and the skiving edge 112, are sufficient to break or sever the magnetic chains which would otherwise bridge the gap 114. Such breaking or severing of the bristles between the magnetic fields causes a first and desired amount of the magnetic developer material D to remain on the outside surface of the development roller 46 therefore passing through the gap 114 and hence under the edge 112 for retention and continued movement by the rollers 46, 44 in the first compartment A. Such breaking or severing also causes a second and desired partial amount of the magnetic developer material D to be removed from the roller 46 by passing over the edge 112. Such a second amount is then directed gravitationally by the plate member 106 away from the development roller 46.

As shown, the plate member 106 is mounted within an opening 116 in the wall 49 which divides the first and second compartments A, B. As such, the second amount of developer material passing over the plate member 106 is directed through the opening 116 into the second compartment B for return by the auger 84 from the rear end 54 to the front end 52 of the apparatus 30.

As further shown, the device 104 is appropriately located towards the very end of the second or rear end 54 of the apparatus 30. Such location allows undisturbed image or character development between the ends, as well as ensures recirculation of only developer material depleted by such development. The amount of such depleted material recirculated depends in part on the size of the gap 114, therefore the plate member 106 is made adjustable so as to enable adjustment of the gap 114. The plate member 106 and the second magnet N6 as shown are each shorter than the development roller 46. The plate 106 and second magnet N6 may be equal in length, and preferable such length should be sufficient to span the width of the developer material flow band H. The first magnet S4, however, is longitudinally as long as the development roller 46.

As can be seen, the development apparatus 30 of the present invention can handle and recirculate the magnetic development material D. In particular, the device 104 including the first and second magnets S4, and N6 located as specified, operate with the skiving plate member 106 to flip and break or sever magnetic bristles of the magnetic chains of such developer material D. As such, magnetic chains are prevented from bridging the gap 114, and the device 104 can therefore effectively remove a desired partial amount of such developer material from the development roller 46 for recirculation therein. Such partial removal and recirculation allows for continued quality image development by the apparatus 30.

The invention has been described in detail with particular reference to a presently preferred embodiment, but it will be understood that variations and modifications can be effected within the spirit and scope of the invention.

What is claimed is:

1. In a development apparatus, having first and second compartments, and a rotatable magnetic development roller mounted in the first compartment, for developing electrostatically formed latent images using magnetic developer material, a device for removing a partial amount of developer material from the outside surface of the development roller, the removing device including:

(a) a first stationary magnet having a first polarity, said first magnet being mounted within the development roller and generating a first magnetic field thereabout for standing magnetic bristles of particles of the magnetic developer material on a first end thereof on the outside surface of the development roller;

(b) a second stationary magnet having a second and opposite polarity, said second magnet being mounted within said development roller and generating a second magnetic field thereabout for standing said magnetic bristles of the developer material on a second and opposite end thereof on the outside surface of the development roller, said second magnetic field relative to the rotation of the development roller being generated immediately downstream of said first magnetic field, thereby tending to cause a flipping of said magnetic bristles from standing on the first end to standing on the second end thereof on the outside surface of the development roller; and (c) a skiving plate member having a skiving edge positioned approximately between said first and second magnetic fields, and spaced a small gap from the outside surface of the development roller, such that said skiving edge partially interferes with, severing said flipping magnetic bristles into a first amount remaining on the development roller and passing through the small gap under said skiving edge for retention in said first compartment, and into a second amount passing over said skiving edge and being directed by said plate member away from the development roller, the length of said skiving edge of said plate member being less than the length of the development roller.

2. The device of claim 1 wherein said first magnet is an S-pole magnet.

3. The device of claim 1 wherein said first magnetic field is stronger than said second magnetic field.

4. The device of claim 1 wherein said first magnetic is longitudinally co-extensive with the development roller.

5. The device of claim 1 wherein said second magnet and said plate member are equal in length.

6. The device of claim 1 wherein said skiving plate member is adjustable so as to vary the size of said gap between the skiving edge thereof and the outside surface of the development roller.

7. The device of claim 1 wherein said first and second magnets are mounted to a stationary core within the development roller.

8. The device of claim 1 wherein said second magnet and said plate member are each shorter than the development roller.

9. The device of claim 1 wherein said plate member is mounted in an opening in a wall separating the first and second compartments for deflecting said second amount of the severed bristles through such opening into the second compartment.

10. A development apparatus for developing latent images on an image-bearing surface in an electrostatographic apparatus using magnetic developer material including magnetic toner particles, the development apparatus including:

(a) an elongate housing having first and second ends, a first side compartment including a first sump portion for holding development material, and a second side compartment including a second sump portion for holding development material;

(b) a first auger mounted in said first sump portion of said first compartment for moving developer material therein from said first to said second end;

(c) a second auger mounted in said second sump portion of said second compartment for moving developer material therein from said second end to said first end;

(d) means located in said housing for transferring developer material from said second compartment over into said first compartment;

(e) a rotatable development roller mounted in said first compartment for moving developer material from said first side towards said second side through a development zone for developing the latent images; and (f) means for removing a partial amount of the developer material from said development roller for transferring into said second compartment, said removing means including:

(i) a first magnet having a first polarity, said first magnet being mounted within said rotatable development roller and generating a first magnetic field for standing magnetic bristles of the magnetic developer material on a first end thereof on said development roller;

(ii) a second magnet having a second and opposite polarity, said second magnet being mounted within said rotatable development roller and generating a second magnetic field for standing said magnetic bristles of the developer material on a second end thereof on said development roller, said second magnet being mounted immediately downstream of said first magnet so as to cause said magnetic bristles to tend to flip from standing on said first end to standing on said second end thereof; and (iii) a skiving plate having a skiving edge positioned spaced a small gap from the outside surface of said development roller, said skiving edge having a length shorter than the length of the development roller, and said skiving edge being positioned approximately between said first and said second magnetic fields for partially interfering with, and breaking said flipping magnetic bristles into a first amount for retention in said first compartment, and a second amount for transfer into said second compartment.

11. The development apparatus of claim 10 and wherein the first and second magnets are mounted upon a stationary core, and a rotatable shell surrounds said core.

12. A development apparatus for developing an image-bearing surface with magnetic toner, the apparatus comprising:

(a) an elongated development roller having a stationary core causing a plurality of elongated magnets thereon, the magnets extending in the axial direction of the roller, and a shell surrounding said magnets mounted for rotation relative to said core for rotation about the axis of the roller;

(b) means for rotating the shell;

(c) skive means extending in the axial direction of the roller for only a minor portion of the length of the roller; and (d) a plurality of said magnets in the vicinity of a development zone extending for a major portion of the circumference of the roller, and wherein one of said magnets located proximate said skiving blade extends for only a minor portion of the circumference of the roller.

* * * * *